United States Patent [19]

Baldi

[11] Patent Number: 4,779,439

[45] Date of Patent: Oct. 25, 1988

[54] METHOD TO ROLL MULTIPLE SECTIONS

[75] Inventor: Ezio Baldi, Piombino, Italy

[73] Assignee: Cerit S.p.A., Pordenone, Italy

[21] Appl. No.: 940,537

[22] Filed: Dec. 10, 1986

[30] Foreign Application Priority Data

Dec. 16, 1985 [IT] Italy ..... 83445 A/85

[51] Int. Cl.[4] ..... B21B 1/18

[52] U.S. Cl. ..... 72/204; 72/221; 72/234; 72/366

[58] Field of Search ..... 72/204, 203, 234, 365, 72/366, 221

[56] References Cited

U.S. PATENT DOCUMENTS

| | | | |
|---|---|---|---|
| 1,977,285 | 10/1934 | McCleery | 72/204 |
| 4,193,283 | 3/1980 | Bowman et al. | 72/204 |
| 4,357,819 | 11/1982 | Elley | 72/204 |

FOREIGN PATENT DOCUMENTS

| | | | |
|---|---|---|---|
| 504328 | 6/1952 | Belgium . | |
| 60309 | 1/1892 | Fed. Rep. of Germany . | |
| 2719964 | 11/1978 | Fed. Rep. of Germany . | |
| 2351746 | 12/1977 | France . | |
| 0130401 | 7/1985 | Japan | 72/204 |
| 2028202 | 3/1980 | United Kingdom . | |

OTHER PUBLICATIONS

Brayshaw, Ernest E., "Rolls and Rolling", Blaw-Knox Company, 1958, pp. 302-305.

Beynon, Ross E., "Roll Design and Mill Layout", Association of Iron & Steel Engineers, Pittsburgh, Pa., 1956, pp. 95 & 123.

*Primary Examiner*—Lowell A. Larson

*Assistant Examiner*—Steven B. Katz

*Attorney, Agent, or Firm*—Wegner & Bretschneider

[57] ABSTRACT

A method to roll multiple sections starting from a single round section, comprising the steps of: (a) passing the single round section between the rolls of a rolling mill to obtain a single bar including two substantially elliptical, united, twin sections, the major axes of the elliptical sections being inclined by an angle ranging between 5° and 30° in relation to an axis normal to the axes of the rolling rolls; and (b) passing the single bar including two substantially elliptical, united, twin sections between the rolls of a rolling mill to obtain twin-strand round sections.

7 Claims, 2 Drawing Sheets

METHOD TO ROLL MULTIPLE SECTIONS

This invention concerns a method to roll multiple sections and also concerns rolled sections thus obtained. It therefore refers to the field of rolling operations and, in particular, to the duplication of determined initial sections, with a view to the production of round rolled sections of small cross sections when starting with one single round section of a pre-determined cross section.

In the known art the concept of duplication by means of rolling or of rolling several sections simultaneously is an art known in itself.

For this purpose reference should be made to "Rolls and Rolling" by Ernest E. Brayschaw, published in 1958, or to "Roll Design and Mill Layout" by Ross E. Beynon, published in 1956, as regards the literature available.

As regards patents, reference should be made, for instance, to DE-PS-No. 60309 of 1891, which teaches a process starting with a square billet and obtaining round sections by producing twin strands, or to U.S. Pat. No. 1,881,020 of 1932, which discloses the slitting of a double, or twin-strand, round section, which has been produced beforehand by rolling. This invention consists substantially of a box with a shears to divide two round sections produced by rolling.

U.S. Pat. No. 1,977,285 of 1934, instead, discloses operations starting with an initial slab and producing therefrom in successive passes angle irons, square sections or channel sections by means of procedures described in that patent.

U.S. Pat. No. 2,191,148, instead, discloses the producing of plates, starting with a wide plate and passing the same through a slitter with shearing disks.

U.S. Pat. No. 2,371,671 of 1943 discloses the obtaining of flat sections from round bars by lateral drawing of the sections.

BE Pat. No. 504,328 of 1951 discloses the rolling of a plurality of round sections, starting with a slab, for instance, so that 6, 8, 10 or more round sections are produced in successive passes according to requirements.

U.S. Pat. No. 3,483,915 of 1969, instead, discloses starting with a substantially hexagonal section having two long flattened sides and producing by successive passes two or more square sections of a suitable cross section.

FR Pat. No. 2.351.746 of 1976 discloses a device substantially like that of U.S. No. 1,881,020 filed in 1930 and approved in 1932.

DE-A- No. 2.719.964 of 1977 teaches the obtaining of round sections by the simple production of twin strands, whereas No. GB-A-No. 2,028,202 of 1978 teaches the obtaining of sections directly from elementary geometric sections.

U.S. Pat. No. 4,193,283, filed in 1978 discloses the duplication of a square billet by rolling.

All these methods entail a plurality of drawbacks, above all as regards the number of passes, energy consumption and wear on the rolls.

Moreover, the stresses produced in the known systems are considerable in the duplication step and in the slitting step, and this fact leads to a heavy energy consumption and, above all, to considerable wear on the rolls.

Furthermore, in the known system involving the division of one single rolled section into more than two portions in the same pass (for instance, the rolling of 3, 4 or more strands) a "camber" effect is produced in the outerost rolled sections owing to the substantial asymmetry of the rolling forces and the diversity of form of the sections of the rolled products running parallel to each other. The above effect has to be restricted by the equipment, which therefore undergoes heavy scraping by the rolled stock and considerable wear as a result. Moreover, slabs or billets are used as the initial material in all cases.

The present invention therefore tends to overcome the drawbacks of known technologies and enables duplication to be obtained easily with a modest energy consumption and with a very limited wear on the rolls.

This invention provides for the duplication of rolled stock when starting with round shapes having a desired cross section.

The method enables perfectly identical shapes as regards form and cross section to be produced either in the first slitting (two strands) or in the subsequent slitting (four strands) and eliminates the shortcomings which make it difficult to set up the methods used so far and to carry out the rolling in practice, above all the rolling with four strands.

During the second slitting (rolling with four strands) the method of the invention does not entail the problem of "camber", which is caused at present when slitting into three or four strands and has so far been restricted by overloading the output equipment.

The smooth round sections produced by the method contain very limited surface faults since the quality of slitting leaves only small traces of the shearing.

According to the invention, when starting with a round section, two substantially elliptical sections are produced having their axes inclined between 5° and 30° to an axis normal to the axes of the rolls, the optimum inclination being advantageously about 10°-15°.

The twin-strand elliptical sections have an overall outer diameter abot equal to the diameter of the initial round section.

Thus, when starting with a round section and producing two ellipsoids with their axes inclined by a desired value in relation to each other, it is possible to reproduce a round section merely by one pass of the elliptical section. The slitting of the twin-strand united sections can be performed with a device of the type shown, for instance, in U.S. Pat. No. 1,881,020 of FR Pat. No. 2.351.746 or with any other slitting device of a known type.

The substantial separation of the two round sections is carried out during the rolling step, which is particularly well finished according to the method and therefore does not cause great separation problems. According to the method the products thus obtained by the twin-strand duplication have identical cross sections, shapes and surfaces.

Constant flows are thus obtained, thus eliminating the defects of loops with take place in other known methods.

Moreover, the method of the invention enables duplication to be carried out in sequence until particularly small diameters are obtained, each twin-strand duplication being obtained with only one intermediate pass.

The invention is therefore displayed with a method to roll multiple sections, which starts with a single round section and obtains twin-strand round sections and is characterized in that it comprises only one single intermediate pass obtaining substantially elliptical, united, twin figures.

The invention is also obtained with a rolled round section produced by twin-strand duplication and starting from another single round section, characterized in that one or more features of the above method are employed.

The attached figures are given as a non-restrictive example and show the following:

Figure 2:
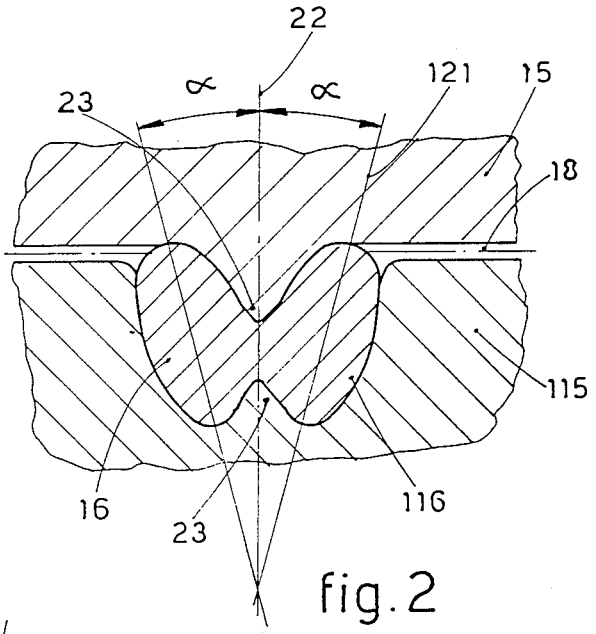
FIG. 2 shows an intermediate section consisting of twin elliptical sections.

In the figures a round section 10, which can have any required cross section, is passed through two grooved rolls 15–115 appropriately shaped circumferentially according to the invention, as shown in FIG. 2; in this way it is possible to obtain twin, geometrically counterpart FIGS. 16–116 having a substantially elliptical conformation. The respective axes 21 and 121 of the geometrically ellipsoidal figures are tilted in relation to the axis 22 of the original round section, such latter axis 22 being substantially normal to the axes of the rolls.

The inclination of the axes of the twin elliptical figures in relation to the original axis 22 may vary between 5° and 30°; the present applicant has found that such angular value will be at its optimum between 10° and 15° and advantageously 13°–14°.

According to the invention the overall outer radius of the twin, geometrically ellipsoidal FIGS. 16–116 is about equal to the radius of the initial round section 10.

With the twin elliptical sections 16–116 it is possible to obtain with one single successive rolling pass through rolls 17–117 twin cylindrical sections 19–119.

Such twin cylndrical sections 19–119 too have their axes 21–121 tilted in relation to the axis 22 of the original round section 10, the inclination of the twin elliptical sections differing from that of the twin round sections substantially by about 1°–2°.

The inclination "alpha" of the twin united elliptical FIGS. 16–116 or 11–111 enables blades 23–123 to be employed with dimensions such that the blades can shear round sections with diameters up to 50 mm. Without difficulty, thus limiting wear of the blades 23–123 themselves.

Moreover, such inclination enables very wide grooves to be used which eliminate the problem of the resulting burrs on the periphery of the round twin sections 19–119.

In fact, such burrs come into contact with the groove of the rolls 15–115 of the next stand after the rotations permitted for the rolled sections 19–119 between one rolling stand and the next one; and therefore the burrs caused by the slitting at 20 are flattened and this fault is substantially eliminated during the passage from twin round sections 19–119 to twin elliptical sections 11–111.

The successive twin geometric FIGS. 14–114 are tilted to enable the section entering to be correctly converted from oval to round.

Figure 3:
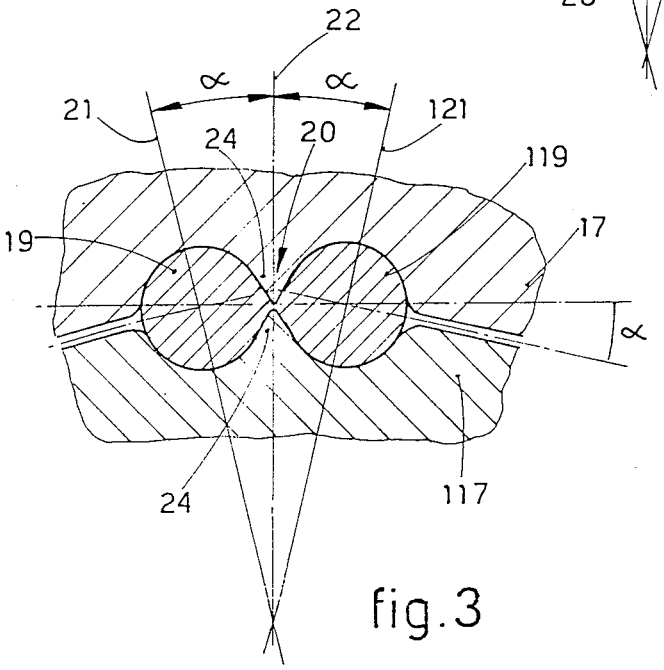
FIG. 3 shows a completed round section according to the invention.

According to the invention, while the gap between the rolls 15–115 in producing the twin elliptical sections lies substantially at the upper divergent portion of the elliptical sections 15–115 (FIG. 2), in producing the twin cylindrical sections 19–119 such gap lies substantially on axes normal to the axes 21–121 of divergence of the twin cylindrical sections (FIG. 3).

According to the invention, four round bars having diameters of 13.5 mm. can be produced from one round section having a diameter of 50 mm. by means of two intermediate passes.

Figure 1:
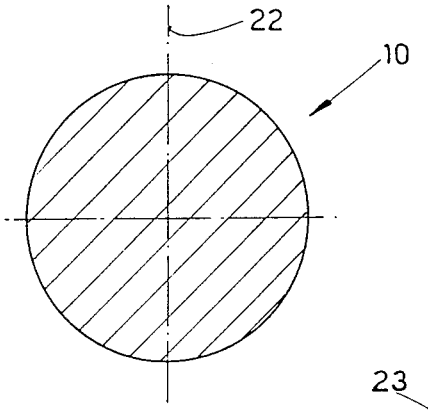
FIG. 1 shows an initial round section.
Figure 5:
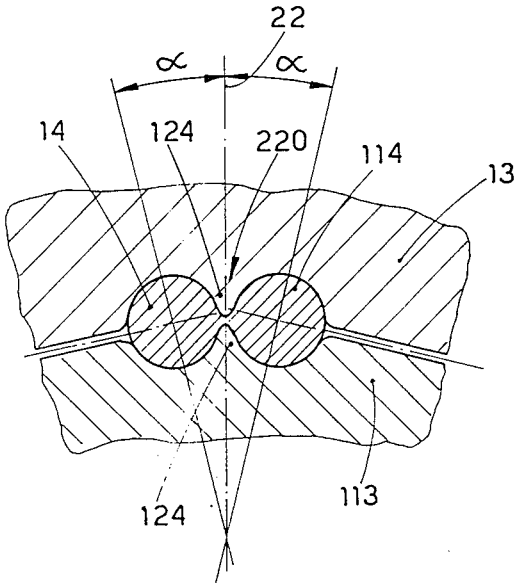

According to the invention, therefore, with an initial round section 10 having a diameter of 50 mm. as in FIG. 1, for instance, it is possible to produce two plus two round sections 14–114 as in FIG. 5, each of which has a cross section with a diameter of 13.5 mm.

Figure 4:
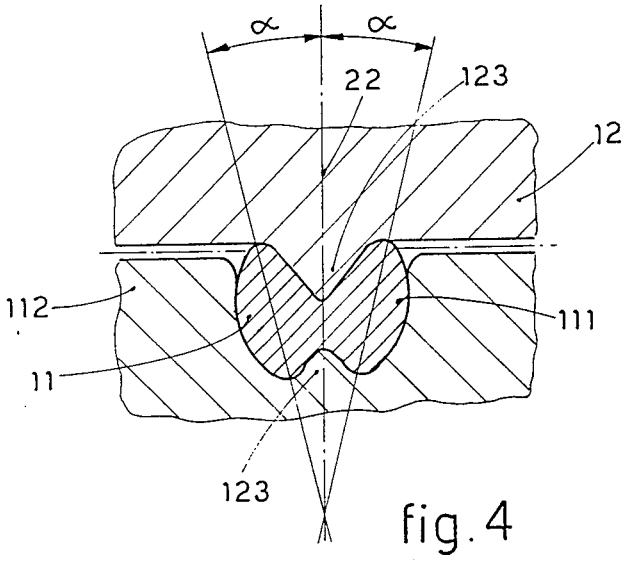
FIGS. 4 and 5 show a further twin-strand duplication of each single round section produced as in FIG. 3.

Thus, according to the invention, starting with a round section 10 of a required diameter and carrying out a pass to produce twin elliptical sections 16–116 (FIG. 2), a pass to produce twin round sections 19–119 (FIG. 3), a slitting of the twin round sections 19–119, a pass of each round section 19–119 to produce twin elliptical sections 11–111 (FIG. 4), a pass to produce twin round sections 14–114 (FIG. 5) and a successive slitting and separation of the twin round sections 14–114 thus obtained, it is possible to obtain a reduction of the final single product down to between 1/13th. and 1/14th. or more, or an intermediate reduction to about 1/3.5th to ¼th. of the original cross section.

Thus by successive twin-strand duplication the invention enables bars of a small diameter to be produced by conversion from a single round section to twin-strand round sections, with reductions to between 1/3.5th. and ¼th., by means of one single intermediate pass and with a great saving of energy, very small wear of the rolls of the mill and with geometric precision and duplication never obtained before.

While the invention has been particularly shown and described in reference to preferred embodiments thereof, it will be understood by those skilled in the art that changes in form and details may be made therein without departing from the spirit and scope of the invention.

I claim:

1. A method to roll multiple sections starting from a single round section, comprising the steps of:

(a) passing the single round section between the rolls of a rolling mill to obtain a single bar including two substantially elliptical, united, twin sections, the major axes of the elliptical sections being inclined by an angle ranging between 5° and 30° in relation to an axis normal to the axes of the rolling rolls; and (b) passing the single bar including two substantially elliptical, united, twin sections between the rolls of a rolling mill to obtain twin-strand round sections.

2. The method as claimed in claim 1 in which said major axes are inclined by an angle ranging between 10° and 15°.

3. The method as claimed in claim 1 in which said major axes are inclined by an angle ranging between 13° and 14°.

4. The method as claimed in claim 1, in which the reduction obtained in the cross section of the twin round sections in relation to the initial round cross section may reach 1/3.5th. to ¼th.

5. The method as claimed in claim 1, in which the substantially elliptical, united, twin figures produced from the initial round section in the intermediate pass have an overall, outer radius about equal to the radius of the initial round section.

6. The method as claimed in claim 5, in which the gap between the rolling rolls when producing the substantially elliptical, united twin figures coincides with the upper divergent ends of such elliptical figures.

7. The method as claimed in claim 6, in which the gap between the rolling rolls when producing the twin round sections lies in the neighborhood of axes normal to the inclined axes of the twin round sections.

* * * * *

UNITED STATES PATENT OFFICE

CERTIFICATE OF CORRECTION

PATENT NO. : 4,779,439

DATED : October 25, 1988

INVENTOR(S) : Ezio BALDI

It is certified that error appears in the above-identified patent and that said Letters Patent is hereby corrected as shown below:

ON THE TITLE PAGE INSERT:

- [73] Assignee: Danieli & C. Officine Meccaniche SpA, of Buttrio, Italy. --.

Signed and Sealed this

Fourth Day of July, 1989

*Attest:*

DONALD J. QUIGG

*Attesting Officer*

*Commissioner of Patents and Trademarks*